United States Patent [19]

Tamary

[11] Patent Number: 4,796,880

[45] Date of Patent: Jan. 10, 1989

[54] SKIVE WITH ANTI-GOUGE STIFFENER

[75] Inventor: Ernest J. Tamary, Rochester, N.Y.

[73] Assignee: Eastman Kodak Company, Rochester, N.Y.

[21] Appl. No.: 947,074

[22] Filed: Dec. 29, 1986

[51] Int. Cl.[4] ..... B65H 29/54

[52] U.S. Cl. ..... 271/311; 271/900

[58] Field of Search ..... 271/311, 307, 308, 312, 271/900, 313

[56] References Cited

U.S. PATENT DOCUMENTS

| | | | |
|---|---|---|---|
| 3,804,401 | 4/1974 | Stange | 271/900 X |
| 3,885,786 | 5/1975 | Schmalabauer . | |
| 3,948,507 | 4/1976 | Stange | 271/308 |
| 3,992,000 | 11/1976 | Martin . | |
| 4,065,120 | 12/1977 | Imalzumi et al. . | |
| 4,080,159 | 3/1978 | Behun | 271/311 X |
| 4,336,992 | 6/1982 | Szlucha et al. . | |
| 4,447,054 | 5/1984 | Sone . | |

*Primary Examiner*—Richard A. Schacher

*Attorney, Agent, or Firm*—Tallam I. Nguti

[57] ABSTRACT

A skive is used for removing a copy sheet from a hot fuser roller in an electrographic copier/duplicator, or the like. The skive has a finger that engages the fuser roller at a small acute angle so that a sheet striking the finger normally will be deflected from the roller along the desired paper path. In order to control flexing of the skive finger, an anti-gouge stiffener is provided adjacent the finger which is engageable by the finger to prevent it from flexing in the wrong direction. The finger and stiffener are connected by a base and can be snapped onto a supporting bar.

4 Claims, 2 Drawing Sheets

SKIVE WITH ANTI-GOUGE STIFFENER

BACKGROUND OF THE INVENTION

The present invention relates to improvements in skives used, for example, for stripping a copy sheet from a hot fuser roller in electrographic apparatus.

Skives comprising elongate fingers have been used for stripping sheet-like members from rollers in apparatus of various types. More specifically, skives have been used for deflecting copy sheets from hot fuser rollers in electrographic apparatus. The fuser rollers in such apparatus commonly have a soft, flexibly outer surface that is flexed as the copy sheet passes through the nip between a fuser roller and a back-up roller or between two such fuser rollers. This soft surface can be damaged by the skive fingers. Damage to the fuser roller can occur, for example, if the sheet leaving the nip between the rollers causes the skive finger to deflect in a direction which urges the tip end of the skive finger into the soft surface of the fuser roller, thereby gouging the roller surface.

Various attempts have been made to avoid the problem of a skive gouging a soft fuser roller. For example, in U.S. Pat. No. 4,336,992, issued on June 29, 1982 in the names of Szluch et al, skive fingers are provided which are sufficiently flexible so that they can be deflected entirely out of contact with the fuser rollers. The fingers can rotate 360 degrees and return to their operating position.

In other known skiving apparatus weights or springs are used to urge the tip end of the skive or sheet stripper into engagement with a rotating roller. Apparatus of this type is disclosed in U.S. Pat. Nos. 3,885,786 and 3,992,000.

In spite of the many efforts to provide satisfactory skives, the gouging problem persits, and results in expensive repair or replacement of the fuser roller and the skive itself. In addition, some prior skives are complex in construction and thus expensive to manufacture. Also, some known skives require accurate adjustment of weights, springs or other elements during assembly, or in order to maintain the required relationship between the skive and fuser roller. Accordingly, there is a continuing need for an improved skive which will not gouge a fuser roller, and which is inexpensive, easy to install and simple to replace.

SUMMARY OF THE INVENTION

It is an object of the present invention to provide an improved skive that avoids gouging of fuser rollers. Another object of the invention is to provide an improved skive that is inexpensive, easy to install and replace, and will not buckle in a direction which causes damage to the fuser roller.

In accordance with the present invention a skive is provided for removing a sheet-like member from a roller or the like. The skive has a finger and an anti-gouge stiffener. The finger is longer than the stiffener and has an end portion engageable with a member, such as a sheet, on the roller to deflect the member from the roller. The finger is flexible in a direction away from the stiffener in response to pressure exerted by a member on the roller. Also, the stiffener is effective to prevent substantial flexing of the finger toward the stiffener under pressure exerted by a member on the roller.

The invention and its objects and advantages will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE DRAWINGS

Figure 1:
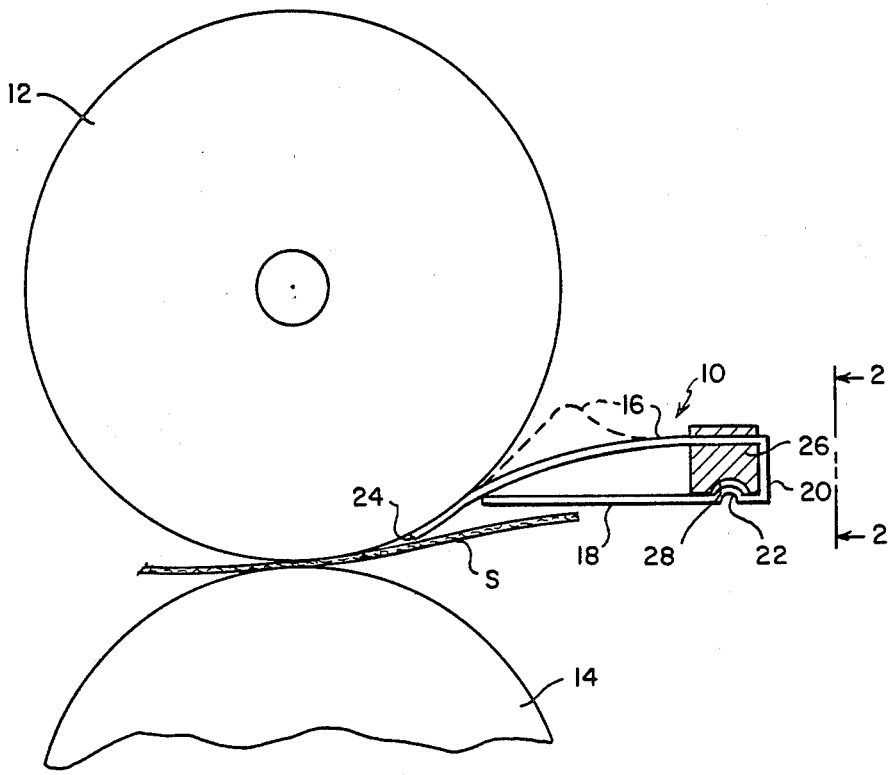
FIG. 1 is an enlarged fragmentary end view of a skive of the present invention shown in position to strip a copy sheet from a fuser roller in an electrographic apparatus.
Figure 2:
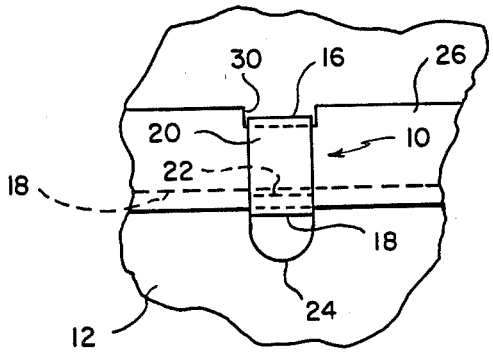
FIG. 2 is a fragmentary view taken from the right side of FIG. 1 generally along the line designated 2—2.

Referring now to the drawings, a skive of the present invention is generally designated 10 and is illustrated in FIGS. 1 and 2 in position for stripping a copy sheets from a hot fuser roller 12 of an electrographic apparatus. The fuser roller fuses an image on the surface of the sheet by heating toner particles on the sheet. The sheet S passes between roller 12 and a second roller 14 which may comprise a hard metal roller that is urged against fuser roller 12 with sufficient force to deflect the soft outer surface of the fuser roller. Alternatively, roller 14 can also be a fuser roller having a soft, flexible outer surface so that rollers 12 and 14 simultaneously can fuse images on opposite faces of the sheet S.

Figure 4:
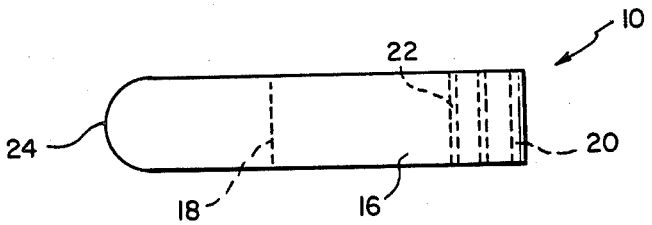
FIG. 4 is a plan view of the unmounted skive show in FIG. 3.
Figure 3:
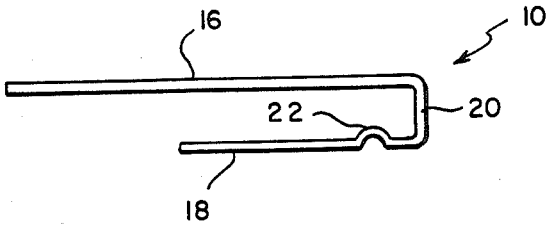
FIG. 3 is a view of the skive per se prior to being mounted in an electrographic apparatus.

Skive 10 is manufactured in a generally U-shaped configuration, as shown in FIG. 3, and includes a flexible finger 16, an anti-gouge stiffener 18 and a base 20. Finger 16 is longer than stiffener 18 and is generally parallel thereto when the skive is not in engagement with a fusing roller or the like. One end of the finger and stiffener are connected to opposite ends of the base 20 so that the finger and stiffener are spaced from each other. Stiffener 18 has a wedge-shaped projection 22 on the surface thereof facing the finger 16. The projection extends the full length of the stiffener and is adjacent the base 20 to facilitate mounting of the skive onto a support as explained later. As shown in FIGS. 2 and 4, the end of finger 16 opposite from base 20 has a rounded, generally semi-circular configuration as shown at 24. This shaped minimizes sharp edges or corners that might tend to gouge the fuser roller 12.

A bar 26 is provided in the electrographic apparatus for supporting one or more of the skives relative to the fuser roller. Bar 26 is generally rectangular in cross-section and has an elongate, continuous notch 28 formed in its lower surface. The notch extends longitudinally along the bar and is positioned to receive projection 22 of the stiffener. One or more grooves 30 are provided in the upper surface of bar 26. The grooves extend transverse to the length of the bar and for the full width of the bar. The width of groove 30 is slightly wider than the width of finger 16 of the skive as shown in FIG. 2.

During assembly of the skive 10 onto the bar 26, the skive is initially aligned with the bar so that finger 16 can enter the groove 30 in the top surface of the bar and with the stiffener 18 extending along the lower surface of the bar. The skive is then moved from right to left as viewed in FIG. 1 with the operator pressing against the skive base 20 to slide the skive onto the bar. When projection 22 of the stiffener 18 reaches the bar the stiffener can flex downwardly until the projection becomes aligned with the notch 28 in the bar at which time the projection snaps into the notch to thereby latch the skive into position on the bar. In FIG. 1, a space is shown between the projection and notch to clearly illustrate these elements. However, in practice the projection fits snugly within the notch. It will be noticed that the slight curvature or ramp at the leading edge of the projecting will assist in deflecting the stiffener during mounting of the skive and also provides a centering or locating feature for establishing the position of the skive on the bar. The groove 30 locates the skive along the length of the bar.

As the skive is moved into position on the bar the end 24 of the finger 16 first engages the curved surface of the fusing roller 12 and then is deflected downwardly from its normal position parallel to the stiffener 18 into its deflected or mounted position illustrated in FIG. 1 wherein the end 24 of the finger is located beneath the stiffener 18. The outer end of stiffener 18 then engages an intermediate portion of the finger 16 adjacent end 24 to stiffen the relatively long finger 16 and yet permit it to flex upwardly as necessary in response to forces encountered during rotation of the fuser roller 12 and engagement of sheets S with the end 24 of the finger 16. Stiffener 18 prevents flexing of the finger in the opposite direction. Thus when the skive is mounted on the bar the end portion of the finger opposite from base 20 is located and held in a position where it defines a small acute angle with the roller 12.

When the skive is fully mounted in position and a sheet S is fed into the nip between rollers 12 and 14, the sheet may tend to adhere to the heated roller 12. If it does, the leading end of the sheet engages the curved end 24 of the finger 16 of the skive and is deflected from the roller. The sheet then travels along a sheet path extending just below the stiffener 18 of the skive. The stiffener and finger 16 thus provide part of the path for a sheet exiting from between the nip of the rollers.

If the sheet is especially difficult to separate from the roller 12, finger 16 may be deflected upwardly a slight distance from its normal bowed condition, as indicated in dotted lines in FIG. 1. Flexing in the direction indicated is not harmful to the skive, sheet or to the surface of the fuser roller. This flexing will increase the pressure exerted by the finger against both the sheet and the fuser roller. However, the end portion 24 of the finger is in a position relative to roller 12 so that it defines a very small acute angle with the tangent of the roller and thus flexing to the dotted line position does not urge the end of the finger into a position where it will gouge the soft outer surface of roller 12. There will be some increase in pressure exerted by the finger due to the flexing and this will further facilitate stripping of the sheet S from the surface of the roller.

The flexing action described above thus can be tolerated, and it is unlikely it will damage the sheet or the fuser roller. On the other hand, if finger 16 flexed downwardly, or in the direction opposite to the direction shown, then the end 24 of the finger could reach a position where it was urged more directly into the surface of roller 12 and could gouge the roller and damage it, possibly making replacement of the roller necessary. Stiffener 18 prevents flexure of the finger 16 by a sheet on roller 12 in a downwardly direction, i.e., in the direction opposite to that shown in dotted lines in FIG. 1. This is due, in part, to the fact that the outer end of the stiffener 18 engages finger 16 adjacent but spaced from the end 24 thereof so that the end cannot be caught by the roller or a sheet S adhered to the roller to flex the finger downwardly. In other words, the end of the stiffener holds an intermediate portion of the flexible finger 16 in a way which prevents it from flexing downwardly. Once the finger begins flexing upwardly as illustrated by the dotted line position in FIG. 1, there are no forces acting on the finger which would tend to flex it downwardly again. Thus gouging of the roller is prevented by the skive 10.

As explained above, the skive is easily mounted on the bar 12 by simply snapping it into position with the projection 22 and notch 28 serving to hold the skive in position and establish its position relative to the fuser roller 12. Moreover, the notch 30 in the bar 26 prevents lateral movement of the skive along the bar. The skive can be easily removed from the apparatus by pulling downwardly on the stiffener 18 and moving the skive to the right as viewed in FIG. 1.

The skive can be made of metal, plastics or other suitable materials. If made of metal the skive preferably is formed from a single sheet or strip and bent into the shape illustrated. Then the skive can be heat treated. A spring steel material is suitable for use in forming the skive. If formed from plastics the skive can be molded into the shape illustrated in the drawings.

The invention has been described in detail with particular reference to a preferred embodiment thereof, but it will be understood that variations and modifications can be effected within the spirit and scope of the invention as described hereinabove and as defined in the appended claims.

I claim:

1. An apparatus having a soft roller and a skive for separating a sheet from the roller, the skive being generally U-shaped in configuration and having a flexible finger and a stiffener each connected at one end to a base, the finger and stiffener being spaced from each other and generally parallel to each other in an unflexed condition, the finger being longer than the stiffener, and means mounting the skive relative to the roller so that the end portion of the finger opposite from the base is flexed and contacts the roller to define therewith a small acute angle, and such end portion of the finger is in contact with the end of the stiffener opposite from the base, whereby the stiffener limits flexing of the finger and prevents its movement to a position wherein the end of the finger could gouge the roller.

2. A skive as set forth in claim 1 wherein the mounting means comprises an elongate bar having a notch, and the stiffener has a projection located and of size to fit snugly in the notch to locate the skive on the bar.

3. A skive as set forth in claim 2 wherein the bar has a groove extending transversely of the bar for receiving the finger and limiting movement of the skive longitudinally along the bar.

4. A skive as set forth in claim 1 wherein the end of the finger opposite from the bar is rounded so that it is unlikely to gouge the roller.

* * * * *